US005803588A

United States Patent [19]

Costa

[11] Patent Number: 5,803,588

[45] Date of Patent: Sep. 8, 1998

[54] LUMINAIRE FOR LUMINESCENT LIGHT SOURCES

[75] Inventor: Paul D. Costa, Burlingame, Calif.

[73] Assignee: Videssencee, Inc., Burlingame, Calif.

[21] Appl. No.: 709,253

[22] Filed: Sep. 10, 1996

Related U.S. Application Data

[63] Continuation-in-part of Ser. No. 675,945, Jul. 5, 1996, and Ser. No. 56,121, Jun. 24, 1996.

[51] Int. Cl.[6] ..... F21S 3/00

[52] U.S. Cl. ..... 362/223; 362/217; 362/225; 362/260

[58] Field of Search ..... 362/217, 216, 362/223, 225, 238, 260, 222

[56] References Cited

U.S. PATENT DOCUMENTS

| | | | |
|---|---|---|---|
| 4,447,859 | 5/1984 | Raczynski | 362/250 |
| 4,464,707 | 8/1984 | Forrest | 362/223 |
| 5,032,958 | 7/1991 | Harwood | 362/217 |
| 5,412,551 | 5/1995 | Newell | 362/217 |
| 5,521,804 | 5/1996 | Degelmann et al. | 362/217 |

*Primary Examiner*—James C. Yeung
*Attorney, Agent, or Firm*—David E. Newhouse

[57] ABSTRACT

A luminaire for luminescent light sources includes: (i) an extruded tubular 'U'-shaped housing having a longitudinal external male dovetail shoulder on one side, a longitudinal external female dovetail channel on its other side, a longitudinal external female dovetail channel on the bottom, two terminating longitudinal 'C'-channel tracks one along the edge of each side leg, and two diametrically opposing interior longitudinal 'C'-channels; (ii) a mounting plate secured by screws received within the internal 'C'-channels at each end of the housing; (iii) electrical power mounting sockets secured to the end plates; (iv) luminescent light tubes mounted in the sockets extending longitudinally within the housing; (v) a reflector surface curling around the luminescent light tubes within the housing; (vi) retractable endcaps resiliently secured by spring biased screws to each endplate closing each end of the housing; and a longitudinal curved transparent lens element having beaded side edges shaped for capture by and sliding within the terminating longitudinal 'C'-channel tracks. The external dovetail side and bottom channels and dovetail shoulders of the invented luminaire interlock with those of another of the invented luminaires allowing a plurality of the luminaires to be connected or ganged together. The retractable endcaps of the invented luminaire include stops registering with the side longitudinal external male dovetail shoulder at one end of the housing and the side longitudinal external female dovetail channel at the opposite end of the housing for arresting sliding translation of an interlocked adjacent luminaire.

7 Claims, 5 Drawing Sheets

LUMINAIRE FOR LUMINESCENT LIGHT SOURCES

RELATED APPLICATIONS

This application is a continuation-in-part of design application Ser. No. 29/056,121 filed by the Applicant Jun. 24, 1996 entitled LUMINAIRE FOR LUMINESCENT LIGHT TUBES, and application Ser. No. 08/675,945 filed Jul. 5, 1996 in the United States of America by applicant, Eric Nieuwklerk entitled: HIGH FREQUENCY DRIVER AND DIMMING CONTROL CIRCUIT FOR GAS DISCHARGE LAMPS assigned to Videssence, Inc., the assignee of this application.

BACKGROUND OF THE INVENTION

1. Field of the Invention

The invention relates generally to modular luminaires for luminescent gas discharge light sources specially adapted for connection to common integrated driving and dimming control circuitry systems.

2. Description of Prior Art

It is well known to utilize high frequency currents pulse for driving gas discharge luminescent lighting fixtures, such as fluorescent lamps. In particular, 60 Hz (cycles per second) line noise is eliminated and illumination efficiency is boosted at higher frequencies. Existing solid state ballasts typically are capable of driving luminescent fixtures at rates ranging from 20 kHz up to 200 kHz.

In U.S. Pat. Nos. 5,012,396, & 5,235,497 P. D. Costa, discloses a method and fixture for illuminating television studio and video production facilities with a plurality of luminescent luminaires providing sustained luminescent light emission from phosphors in the emulsion coating lining the interior of the luminescent light tubes. In particular, electrical current pulse trains within each luminescent lamp tube excite flashes ultraviolet light from Hg vapor in the tubes at rates sufficient to excite/stimulate overlapping pulses of fluorescent and phosphorescent (luminescent) light emission of a desired color, termed chromacity. In particular, each stimulated luminescent light pulse should have a duration greater than that of the exciting electrical current pulses, such that each luminescent light pulse emitted overlaps emission of the subsequent luminescent light pulse excited/stimulated.

To excite overlapping or 'sustained' luminescent light pulses suitable for video, television and film production requires a 'ballast' or driver circuitry operating from 10,000 up to 200,000 cycles per second. (10 kHz to 200 kHz) generating current pulses having durations from a low of 2.5 microseconds for a 200 kHz driver circuitry to a high of 50 microseconds for the 10 kHz driver circuitry. The electrons in the current pulses streaming in a stable glow discharge between the tube electrodes in turn interact with valence electrons of atoms of mercury in the low density gas within the tube to generate flashes of ultraviolet (UV) light. The UV flashes typically have shorter durations than the current pulses because the electrons stream in opposite directions in each successive current pulse, i.e., the polarity of the electrodes at the opposite ends of the luminescent light tubes reverse for each half cycle of the driver circuit to generate two electron current pules which steam in opposite directions. This means that there are discrete time intervals between successive ultraviolet flashes when the UV light flux density or intensity is below a threshold point or value for stimulating sufficient flux or intensity of visible luminescent light from the phosphors lining the luminescent light tube.

It is also important to understand that there are both prompt or fluorescent and delayed or phosphorescent luminescent light emissions excited from the phosphors lining the light tube. The prompt or fluorescent light emission begins within 10 nsec ($10^{-9}$ sec.) of the exciting stimulus and ceases within 10 nsec. after excitation stops. The delayed or phosphorescent light emissions can begin after 10 nsec. of the exciting stimulus but persists beyond 10 nsec. after excitation stops [See *Van Nostrand's Scientific Encyclopedia* $6^{th}$ *Ed.* 1983 pp. 1237, 1788 & 2204.] The bandwidths of prompt or fluorescent light emissions in many instances are different than the bandwidths of the delayed or phosphorescent light emissions. Also, the phosphor compounds which fluoresce may be different from those that phosphoresce.

Color television cameras, video cameras, color photography films, digital electron scanning cameras and the human eye each sense or perceive discrete bandwidths of light which are then recombined, integrated and interpreted in a nonlinear fashion as a particular color. In contrast to incandescent lighting fixtures which are characterized with reference to Stefan-Boltzman "blackbody emission temperatures " or 'color temperatures', luminescence light consists of relatively narrow bandwidths of light emissions which do not follow blackbody laws. (A laser is a common example of a luminescent light source producing a coherent amplified light emission in narrow bandwidths.) Spectral output of luminescent light sources are better characterized in terms of a index which provides a comparison of colors illuminated (by the luminescent light) to those same colors illuminated, for example, by direct 'white' noon sunlight. (Direct 'white' sunlight typically between noon and 2:00 P.M. is the practical standard for determining color for human vision.) Manufacturers of luminescent light tubes try to blend phosphors to produce different bandwidth distributions of radiant energy usually identified with proprietary trademarks e.g. LUMILUX® Descriptive terms such as cool white, warm white, daylight are also frequently relied upon. However, most luminescent light tube manufacturers ultimately resort to characterizing the distribution of different bandwidths of light emitted by their blends of phosphors as producing an effect of illumination equivalent to that produced by incandescent Tungsten filaments at particular temperatures expressed in degrees Kelvin (° K.), in tacit recognition of the predominance of Stefan-Boltzman blackbody emission standards.

A better index for characterizing the light output of luminescent light tubes having a selected blend of phosphors emitting a distribution of different narrow spectral bandwidths of light would be the SRGB™ standard developed by the Applicant which attempts to characterize the relative radiance of respective red, blue and green primary color bandwidths of sustained luminescent light emanated by a blend of phosphors reflecting from known sets of standard gray scale charts and color band charts.

In particular, thecolor of a surface is the bandwidths of the light reflected from that surface. Such reflected light can be captured, digitally imaged and then sampled using conventional eye dropper tools associated with most computer graphics, design, and image processing software programs for measuring and characterizing such parameters as brilliance, saturation, hue, tint, shade or whatever, in terms of the various color-model systems used by the programs for specifying color. In a sense, the optical capture system, and associated computer and software tools function as a reflection meter picking up diffusely reflected light from a standard chart to provide a quantitative color evaluation of the spectral content of that reflected light in terms of color(s) seen by the observing human user.

For example, in the RGB additive model, demonstrated by James Clerk Maxwell to the Royal Institution in London in 1861, various brightness values of red green blue light combine or add to form the color displayed by typical CRT television or computer monitor screens. The L*a*b* (Lab) model developed by CIE[1] mathematically specifies a luminance or lightness (L) value and two chromatic components values (a) specifying a range from green to magenta, and (b) specifying a range from blue to yellow in a way that is supposed lo be device independent. The CMY and CMYK color-model system for photography and printing are a subtractive/ multiplicative models which specify values for cyan (C), magenta (M), yellow (Y) filters and ink which absorb light. Values for black (K) inks are specified in printing because available C, M & Y inks combine to reflect a muddy brown. [*See Van Nostrands' Scientific Encyclopedia 7th Edition*, Vol. 1, pp. 36 & 701, Vol. 2 pp. 2203, 2714] In HSB and HLS color models, an achromatic 'gray scale' value termed 'brilliance' (B) or 'lightness' (L) is specified along with two chromatic values specifying 'hue' (H) and 'saturation' (S). Saturation is a parameter relating to purity of the color, gray being zero. In the HSB model, colors having a more pronounced hue are more chromatic, i.e., differ more from a gray of the same 'brilliance' or 'lightness' 'Brilliance' and 'hue' can in turn be related by using such terms as 'tints' and 'shades.' A chromatic. color having little 'hue' but high 'brilliance' is termed a 'tint', e.g., pink, whereas color of low 'hue' and low 'brilliance' is termed a 'shade', e.g. brown. [1] Centre International d'Eclairage, an international organization which began establishing specifications for color in 1931. CIE has developed a number of comparable standards including CIE XYZ, CIE xyY, CIE L*u*v* and CIE L*a*b*. The television broadcast industry in fact specifies desired chromacities in picture tube output which then relate to gamma corrected voltages corresponding to red green and blue signals. See 47 CFR § 73.682(20)(iv).

Modern personal computers and associated graphics, design and imaging software programs and tools provide RGB image displays which allow users to manipulate and evaluate color by varying values in one or more of the common and proprietary color modeling schemes using side-by-side color comparison boxes. Such computers and software tools thus, in a very real sense, allow the bandwidth sensitivity of human perception to be integrated into the evolution of illumination standards for producing images of studio subjects and talent.

The titanium dioxide in the emulsion coatings scatters and mixes the luminescent light emissions from the different phosphor compounds in the coating. For example, Ad Lagendijk of the University of Amsterdam and the FOM-Institute for Atomic and Molecular Physics in the Netherlands reported his discovery at the American Physical Society Meeting in March 1991 held in Cincinnati, Ohio, that the velocity of light propagating through a highly disordered scattering medium such as a dispersion of titanium dioxide, appears to be one tenth of that previously assumed. [See Science News 23 Mar. 1991, Vol. 139, No. 12, p. 182.] Then Nabil M. Lawandry of Brown University reported in the Mar. 1994 issue of *Nature*, that he and his coworkers were startled and surprised to discovery that certain dyes when dissolved in a liquid containing tiny particles of titanium dioxide when stimulated by an external energy source, amplify the (luminescent) light emitted by the excited dye (phosphor) molecules. In their experiment, Lawandry et al used a green laser to excite photoluminescent molecules of rhodamine dissolved in menthol. Adding titanium dioxide particles greatly amplified the emitted light. The surprising result was that a medium containing particles that reflect light in all directions can somehow amplify the emitted radiation. [See also *Science News* 9 Apr. 1994, Vol. 145, No. 15, pp. 228–229.]

The stability of light emission from luminescent light tubes and capability of blending phosphors to produce distributions of different spectral bandwidths of luminescent light emission permits tailoring to achieve a proper balance of sustained red blue and green bandwidth light emissions optimized for electron scanning television cameras, color films and even two human eyes. However, electronic scanning cameras, including charge-coupled devices (CCDs) which record television and video color images do not mimic human eyes, but rather generate signals representative of spectral energy in separate red, blue and green light bandwidths reflecting off an object. This is accomplished by separating red, green and blue images of the object from the incoming light using, for example, a spilt-cube separation optical system which has appropriate Diacluonic coatings which allow transmission of one bandwidth along the principal optical axis while reflecting the other two bandwidths to into two adjacent channels typically located on opposite sides of the principal optical axis. The three separate color images are directed onto and are converted into electrical image signals by three separate photosensitive or CCD surfaces. Single tube systems use a subtractive color process interposing an array of crossing filters strips to selectively pass representative bandwidths of light. In either case, the resultant electrical signal is then processed to produce signals representative of the respective red, blue and green light bandwidths reflected from the object. [See *Television and Audio Handbook*(1990) K. Blair Benson & Jerry C. Whittaker pp. 6.6, 6.7; and Television Engineering Handbook (1986) K. Blair Benson Chap. 4, pp. 4.56–4.76, & Chaps. 11.]

The electrical images signals obtained by such electron scanning cameras can then be manipulated to provide color corrected or false color images when reproduced at a television/video monitor screen. It is even possible to electronically subtract the image signal in one or more channels and substitute an image signal from a completely different source to produce a composite image at the monitor screen. The electronic systems driving the monitor screens or displays utilize the electrical images signals generated by the cameras for driving an additive color process for reproducing hues of the object imaged. [See *Television Engineering Handbook* (1986) K. Blair Benson Chap 12]

In contrast to electronic imaging, in film, color images are reproduced principally by a subtractive color process using colorant filters for controlling the amounts of red blue and green light reflected from an object to create a positive or negative image of the object in a light sensitive chemical emulsion. [See *Van Nostrarads'Scientific Encyclopedia 7th Edition*, Vol. 2 pp. 2203, 2714]

Finally, the UV radiation flashes driving the luminescent light emission from phosphors imparts cyclic variation to the stimulated light. If the cyclic variation is slow as when using 60 Hertz ballasts (producing 120 flashes per second), rapidly moving objects illuminated produce "blurred ghost like" images referred to is a stroboscopic effect. The illumination industry characterizes cyclic variation in luminescent light emissions as flicker specifying a Flicker Index which is a relative measure of the cyclic variation in output of various sources at a given power frequency.

SUMMARY OF THE INVENTION

The invented luminaire for luminescent light tubes features an extruded tubular 'U'-shaped housing having a longitudinal external male dovetail shoulder on one side, a longitudinal external female dovetail channel on its other side, two terminating longitudinal 'C'-channel tracks one along the edge of each side leg, and two diametrically opposing interior longitudinal 'C'-channels. A mounting plate is secured by screws received within the internal 'C'-channels at each end of the tubular housing for supporting electrical power mounting sockets. Luminescent light tubes are mounted in the sockets and extend longitudinally within the housing. A curved reflector curls around the luminescent light tubes within the tubular housing. A longitudinal extruded curved transparent lens element with beaded side edges captured and sliding within the terminating longitudinal 'C'-channel tracks of the housing directs light output. The external dovetail side channel and dovetail shoulder of the housing interlock with those of another housing allowing a plurality of the luminaires to be connected or ganged together. Retractable endcaps resiliently secured by spring biased screws to each mounting plate close each end of the housing and provide at least two stops each registering with either the external dovetail side mounting channel dovetail mounting shoulder of the housing for arresting sliding translation of an interlocked mounted adjacent luminaire.

The principle advantage of the invented luminaire for luminescent light tubes is in the fabricating of its component parts to accommodate one or more luminescent light tubes of any length. In particular, the extruded tubular housing, curved reflector and extruded transparent lens element can each be cut to provide a housing of any appropriate length. Electrical mounting sockets appropriate for either single axis or 'U'-shaped luminescent light tubes may be secured to the mounting plates.

Other advantages and features of the invented luminaire for luminescent light tubes relate to ease removal and replacement of luminescent light tubes by the simple expedient of sliding the extruded transparent lens element slides longitudinally within the terminating longitudinal 'C'-channel tracks at the end of each leg of the extruded housing to allow access into its interior.

Still other features, aspects, advantages and objects presented and accomplished by the invented luminaire for luminescent light tubes will become apparent and/or be more fully understood with reference to the following description and detailed drawings of a preferred and exemplary embodiments.

DESCRIPTION OF PREFERRED AND EXEMPLARY EMBODIMENTS

Figure 1:
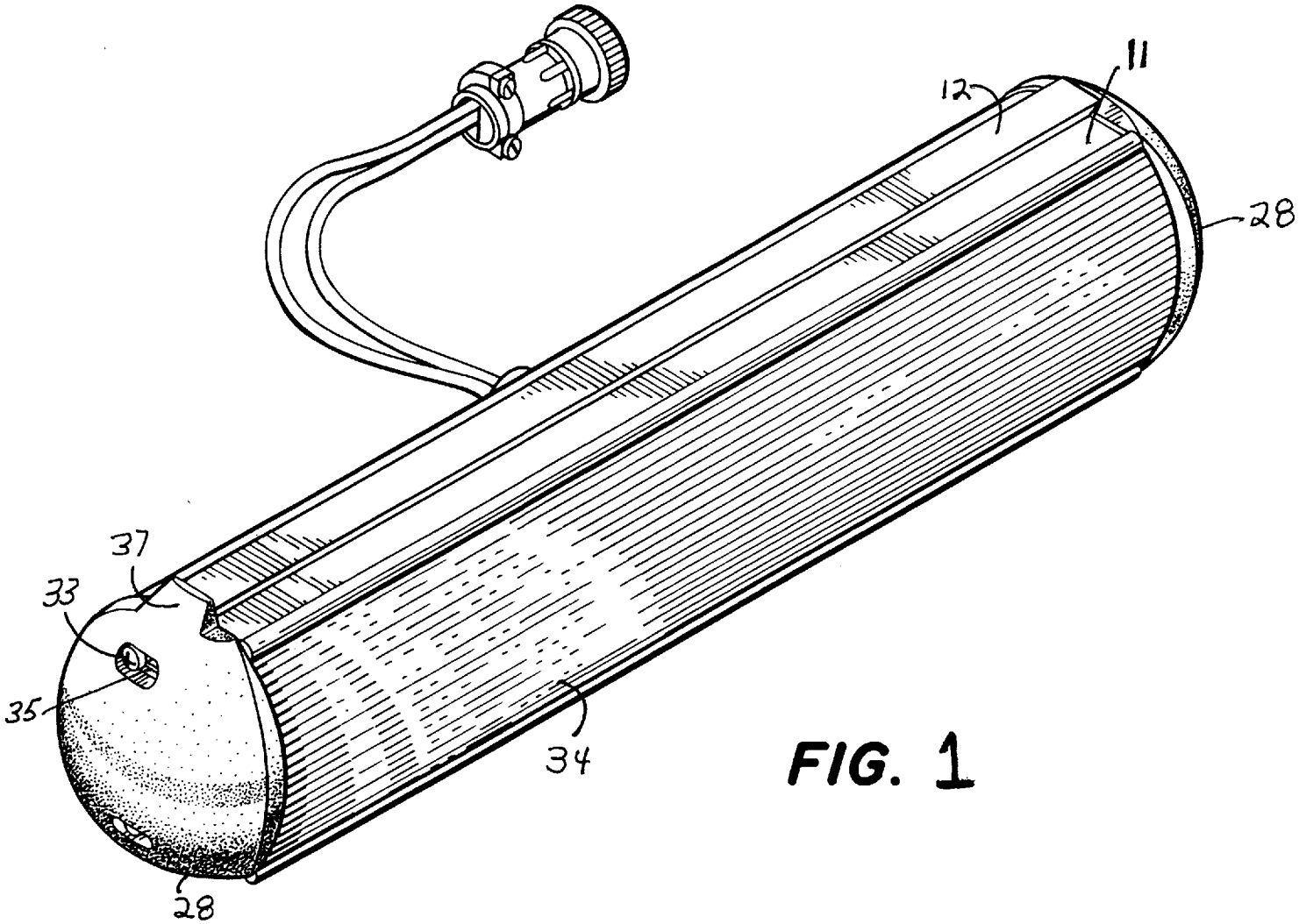
FIG. 1 presents a perspective view of the invented luminaire for luminescent light tubes.
Figure 2:
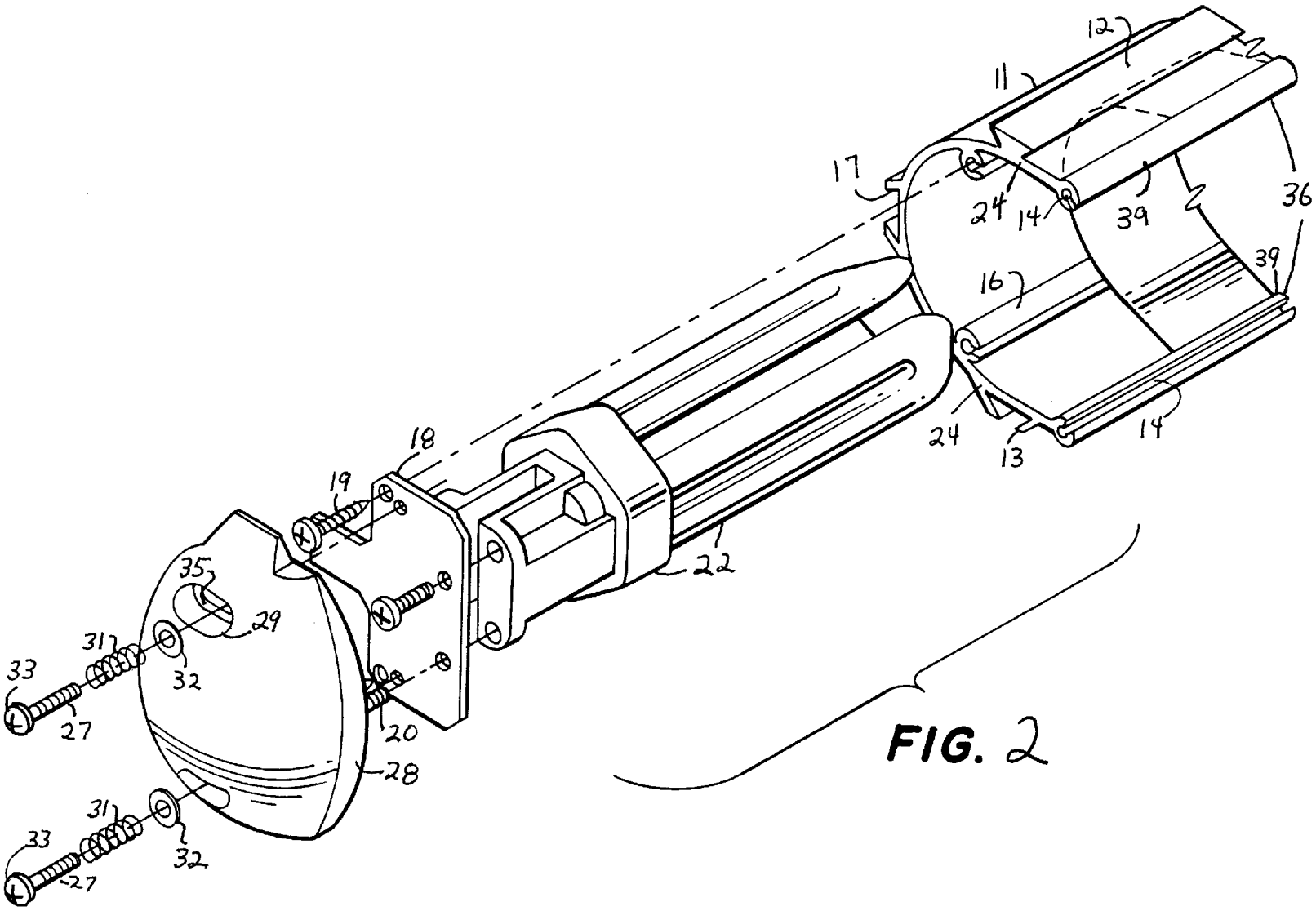
FIG. 2 presents an exploded perspective view showing the essential components at each end of the invented luminaire for luminescent light tubes.

Looking at the figures the major components of the invented luminaire for luminescent light tubes are: (i) an extruded tubular 'U'-shaped housing 11 having a longitudinal external male dovetail mounting shoulder 12 on one side, a longitudinal external female dovetail mounting channel 13 on its other side, two terminating longitudinal 'C'-channel tracks 14 at the end of each side leg of the housing 11, and two diametrically opposing interior longitudinal 'C'-channels 16; (ii) a curved longitudinal reflector 38 seated within the housing 11; (iii) a mounting plate 18; (iv) electrical power mounting sockets 21; (v) luminescent light tubes 22; (vi) end caps 28; and (vii) an extruded curved lens element 34 with beaded side edges 42 sized to be captured by and to slid within the terminating 'C'-channels 14 at the ends of the side legs of the housing 11.

In the embodiment illustrated, the 'U'-shaped extruded housing 11 also includes a longitudinal external female dovetail mounting channel 17 along it bottom side. This latter dovetail channel 17 may be used for securing the invented luminaire to a stand or mounting bracket (not shown). Suitable materials for the extruded housing 11 include aluminum and extrudable polymeric materials such as urethane, HDPE, polypropylene and polyethylene.

Shown in FIGS. 2, 3, 4 & 5, the mounting plate 18 is secured by screws 19 received within the internal 'C'-channels 16 at each end of the 'U'-shaped extruded housing 11. The electrical power mounting sockets 21 are secured to the mounting plate 18 by screws 20. Luminescent light tubes 22 in turn plug into mounting sockets 21 and extend longitudinally within the extruded longitudinal 'U'-shaped housing 11. A concave reflector 38 curls around within the 'U'-shaped housing 11 for reflecting light emitted from the luminescent light tubes 22 out the open top 36 of the 'U'-shaped housing 11. Each mounting plate 18 includes a tang 23 which extends down to rest at the bottom of the end surface edge 24 of the housing 11. The tang 23 provide a third support point for the plate at the end of the housing 11 to assure a stable mounting plane relative to the longitudinal axis of the housing. Two threaded holes 26 aligned in a common plane are cut though the mounting plates 18 to receive machine threaded screws 27 for fastening cast endcaps 28 at each end of the extruded 'U'-shaped extruded housing 11.

In particular, looking at FIGS. 2, 3, 6*a* & 6*b*, the cast endcaps 28 provide a pleasing convex external surface terminating each end of the 'U'-shaped extruded housing 11. Each endcap 28 has two translation slots 29 located for registering with the threaded holes 26 cut though the mounting plate 18. The machine screws 27 extend through the translation slots 29 of the endcaps 28. Compression springs 31 and washers 32, journaled around the shank of each screw 27 between the screw head 33, with the washers 32 seating upon a shoulder 35 within the respective slots 29, urge the respective endcaps 28 against the end surface edge 24 of the housing 11.

Preferably, the endcaps 28 include a flat interior circumferential or rim surface (not shown) shaped for registering with the end edge surface 24 of the housing 11. The extruded convex curved lens element 34 bells out from the open top 36 of the extruded 'U'-shaped housing 11 as shown in FIGS. 1, 3, 6*a* & 6*b*. The endcaps 28 also include at least one side circumferential protrusion 37 located for registering with a side dovetail mounting shoulder 12 or dovetail mounting channel 13 of the housing 11 depending on whether the endcap 28 is mounted at the right or left end of the extruded housing 11. In particular, it is not necessary to cast a 'left' and a 'right' endcap 28 because mounting identical endcaps 28 at opposite ends of the housing 11 switches the parity of the respective protrusions 37 to register with the respective external dovetail shoulder/channel 12/13 on opposite sides of the housing.

As illustrated, and the endcaps 28 preferably include a bottom circumferential protrusion 38 located for registering with the bottom dovetail mounting shoulder or channel 17 of the housing 11. The circumferential protrusions 37 & 38 function as stops preventing translation of an adjacent similar luminaire secured to or mounted on an exterior side of the housing 11 having an exterior dovetail shoulder 12 or channel 13 received in or receiving the particular channel 13 or shoulder 12. of the adjacent luminaire. The bottom circumferential protrusions 38 of the endcaps 28 serve a similar function stopping sliding translation of the invented lumniaire with respect to a conforming shoulder of a mounting bracket received within the bottom dovetail channel 17.

Figure 3:
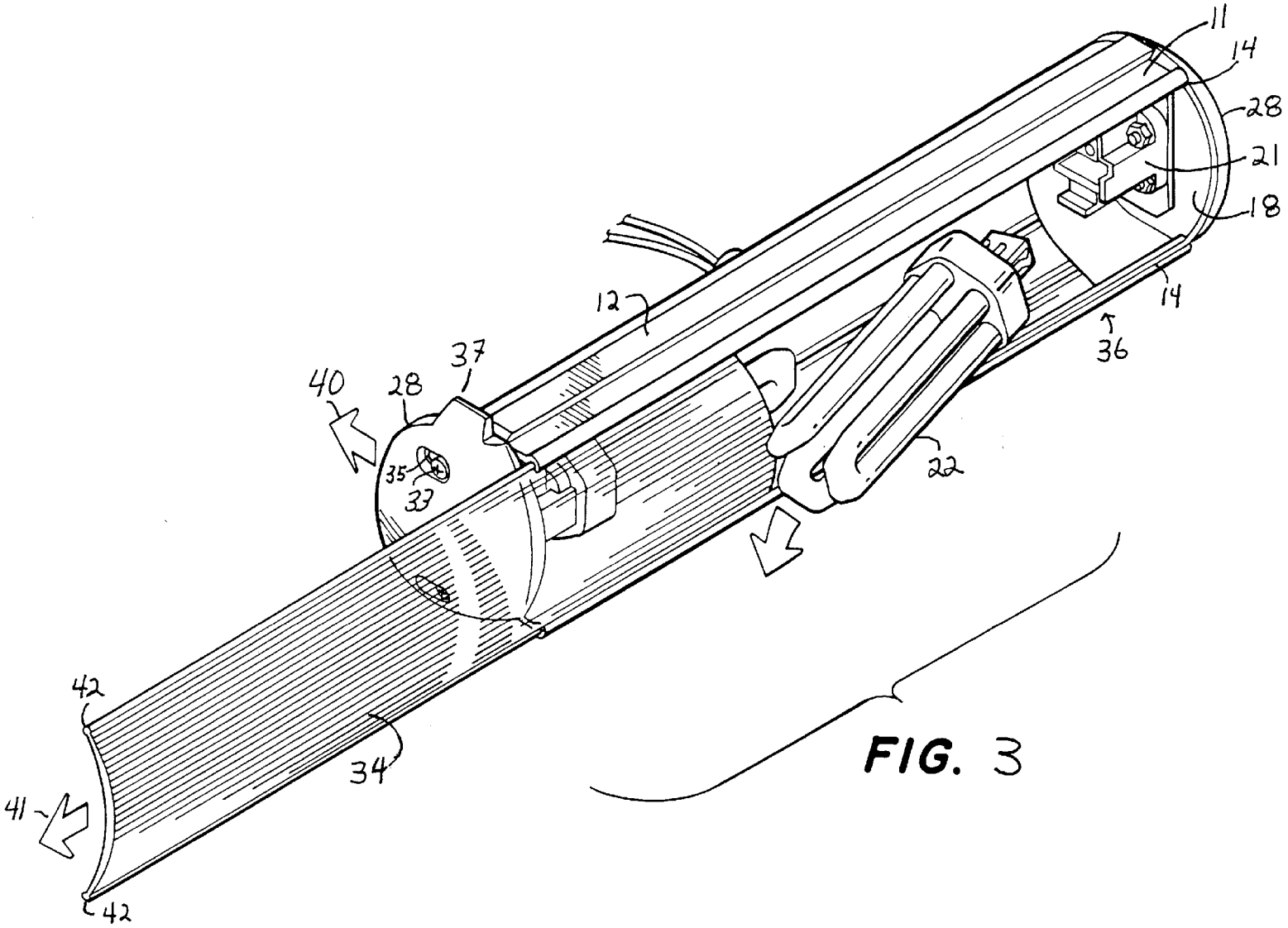
FIG. 3 is a perspective view of the invented luminaire for luminescent light tubes showing sliding translation of the extruded lens element to allow access for removal of a typical socket mounted 'U'-shape multiple tube luminescent light.
Figure 5:
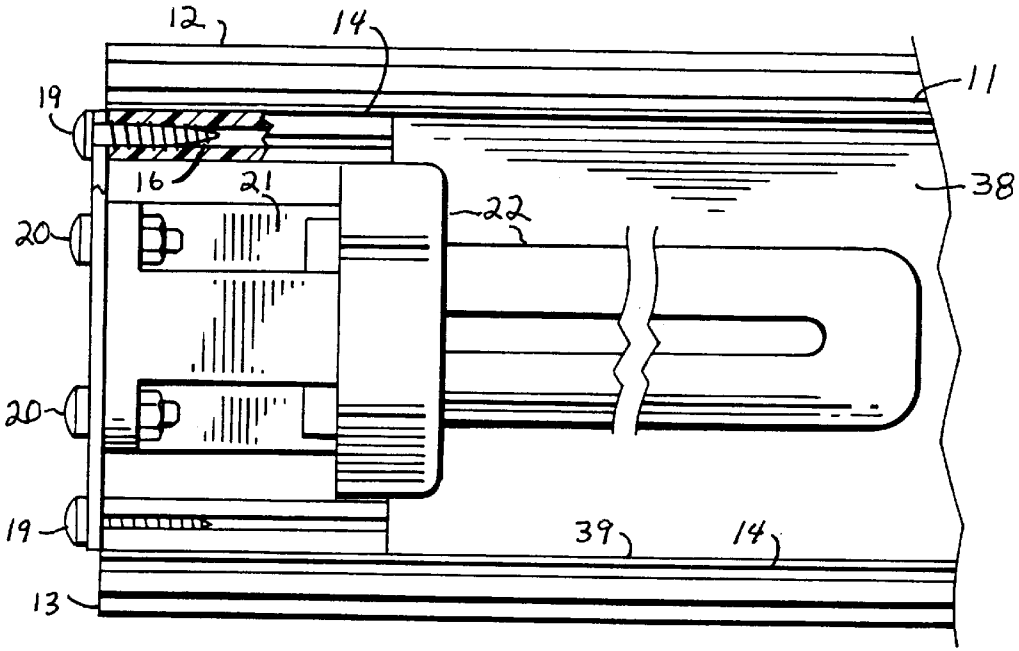
FIG. 5 is a view taken from plane 5—5 of FIG. 4 looking down into the invented luminaire for luminescent light tubes.
Figure 4:
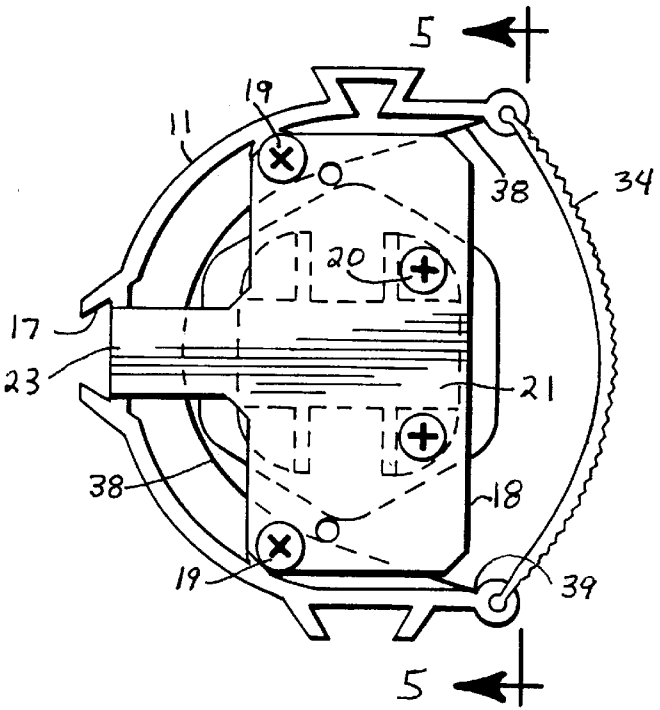
FIG. 4 is an end elevation view showing the relationship of the mounting plate, light tube socket and housing of the invented luminaire for luminescent light tubes.
Figure 6B:
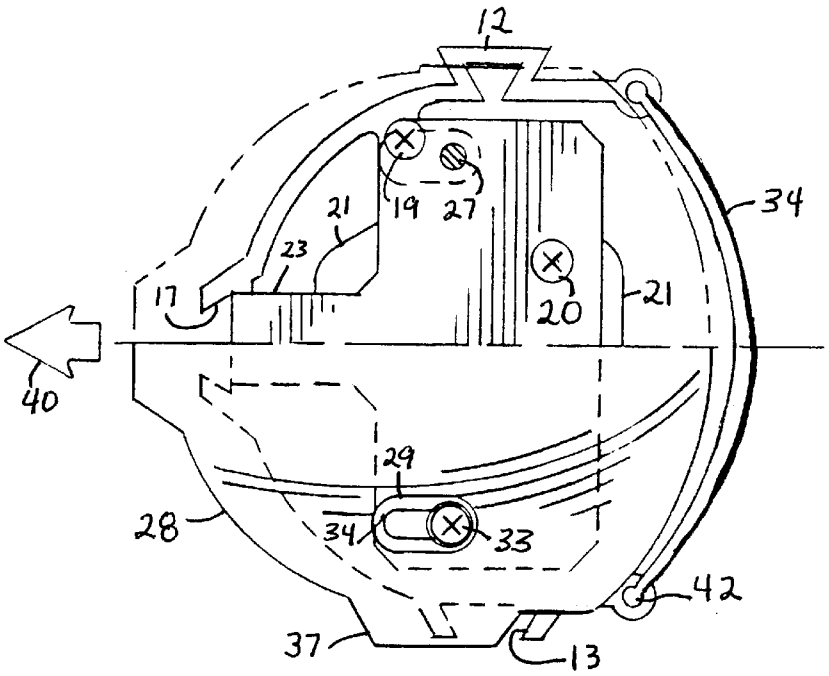
FIGS. 6*a* and 6*b* illustrate translation of the endcaps of the invented luminaire for luminescent light tubes from a closed position (6*a*) to an open position allowing sliding translation of the extruded longitudinal lens element within the terminating longitudinal 'C'-channel tracks at the end of each leg of the extruded housing.
Figure 6A:
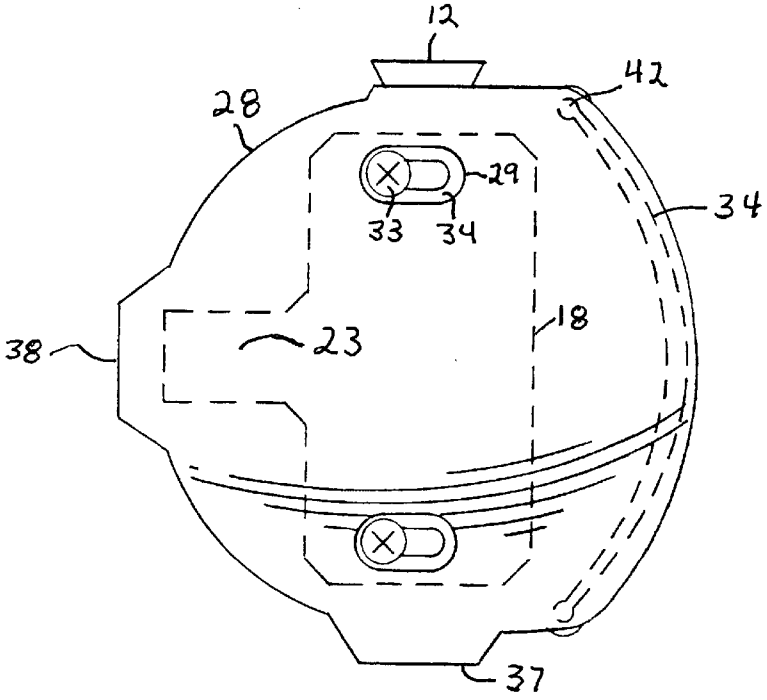

Referring to FIGS. 3, 6*a* & 6*b*, the interior of the invented luminaire can be accessed by first translating an endcap 28 at one end of the extruded 'U' shaped housing 11 downward as indicated by the arrows 40 in FIGS. 3 & 6*b* and then sliding the lens element 34 longitudinally with respect to the housing 11 as indicated by the arrow 41. In particular the side edges 42 of the extruded lens element 34 are beaded and sized for capture and sliding within the terminating 'C' channels 14 at the end of each side leg of the housing 11. It should also be appreciated that the convex external surface of the endcaps 28 means a concave internal surface which allows the endcaps 28 to tilt outward from the ends of the housing 11 once translated downward out of registry with the end edge surface 24 of the housing. Once opened, a malfunctioning luminescent light tube 22, defective mounting socket 21 and even the curved reflector 38 can be easily removed from the interior of the extruded 'U'-shaped housing 11 as indicated by arrow 43 in FIG. 3.

The curved reflector 38 is, in essence, a sheet of aluminum or similar material high having a highly reflective surface, smoothly bent into a hemi-cylindrical concave configuration with the highly reflective surface facing inward. Preferably, the diameter of the curved reflector 38 is slightly greater than perpendicular distance between the sidewalls of the extruded 'U'-shaped housing 11 such that by squeezing and compressing, the reflector 38 diametrically slightly (within the elastic limit of the reflector material) allows it to be positioned within the housing 11, whereupon the curved reflector springs diametrically out to seat against the sidewalls of the 'U'-shaped housing 11. Shoulders 39 defining the terminating longitudinal 'C'-channels 14 at the end of each side leg of the extruded 'U'-shaped housing 11 provide an abutting structure for engaging the edges of the curved reflector 38 to prevent it from popping out of the housing 11.

The invented luminaire has be described in context of a specific embodiment preferred by the applicant. It should recognized that skilled designers can specify different components for a luminaire other than those shown and described by the applicant which will perform substantially the same function, in substantially the same manner to accomplish substantially the same result as those components specified by the applicant in describing his preferred embodiment. Accordingly, while such other possible suitable components for the invented luminaire are not exactly described or disclosed herein, they will fall within the scope and spirit of the invention as described and set forth in the appended claims.

I claim:

1. A luminaire for a luminescent light tube comprising in combination:

a. an extruded 'U'-shaped tubular housing having two diametrically opposing interior longitudinal 'C'-channels, and two terminating longitudinal 'C'-channel tracks one along each edge of each side leg of the extruded 'U'-shaped tubular housing;

b. a mounting plate secured by means received and captured within the respective internal 'C'-channels at each end of the tubular housing;

c. a mounting and electrical connection socket secured to each mounting plate electrically connectable to a source of electrical power;

d. at least one luminescent light tube extending longitudinally within the 'U'-shaped tubular housing mounted and electrically connected to at least one of the sockets;

e. a light reflecting surface mounted curling around the luminescent tube within the tubular housing for reflecting light from surfaces within the 'U'-shaped tubular housing; and f. an end cap secured to each mounting plate for closing each end of the 'U'-shaped tubular housing;

g. a longitudinal curved transparent lens element having beaded side edges shaped for capture by and sliding within the terminating longitudinal 'C'-channel tracks along the edge of each side leg;

h. means for resiliently securing each cap to each of the mounting plates urging each end cap against the end of the housing, and for allowing each end cap to translate perpendicularly with respect to the longitudinal axis of the tubular housing.

2. The luminaire of claim 1 wherein the end caps each have a cord diameter at least equal to a perpendicular outside cross-section dimension between the terminating longitudinal 'C'-channel tracks along the edge of each side leg of the extruded 'U'-shaped tubular housing for blocking the respective terminating longitudinal 'C'-channel tracks, the slots penetrating through the end caps being oriented perpendicularly with respect to a plane crossing between the terminating longitudinal 'C'-channel tracks, whereby the end cap retracts downward for unblocking the respective terminating 'C'-channel tracks.

3. The luminaire of claim 2 wherein the means for resiliently securing each end cap to each of the mounting plates urging each end cap against the end of the housing, and for allowing each end cap to translate perpendicularly with respect to the longitudinal axis of the tubular housing comprises, in combination:

(i) a pair of aligned longitudinal slots penetrating through the end cap oriented perpendicularly with regard to a longitudinal axis oriented parallel to the extruded 'U '-shaped housing, (ii) a pair of threaded holes drilled into each end plate located to register with the slots penetrating through the particular end cap closing that end of the tubular housing;

(iii) a screw having a head and a threaded shank, the shank extending through the each slot through the end cap screwing into the registering threaded hole cut into the end plate;

(iv) a helical compression spring disposed around the shank of each screw between the head and the end cap, whereby, each end cap is translatable perpendicularly with respect to the longitudinal axis of the tubular housing with the compression springs resiliently urging the end cap against the end of the housing.

4. A luminaire for a luminescent light tube comprising in combination:

a. an extruded 'U'-shaped tubular housing having two diametrically opposing interior longitudinal 'C'-channels, an external, longitudinal, male dovetail shoulder on one side of the housing, and an external, longitudinal, female dovetail channel on an opposite side of the housing, wherein the external, longitudinal, male dovetail shoulder on one side of the 'U'-shaped tubular housing and the external, longitudinal, female dovetail channel on an opposite side of the 'U'-shaped tubular housing are configured to interlock, whereby at least two luminaires can be connected together;

b. a mounting plate secured by means received and captured within the respective internal 'C'-channels at each end of the tubular housing;

c. a mounting and electrical connection socket secured to each mounting plate electrically connectable to a source of electrical power;

d. at least one luminescent light tube extending longitudinally within the 'U'-shaped tubular housing mounted and electrically connected to at least one socket;

e. a light reflecting surface mounted curling around the luminescent tube within the tubular housing for reflecting light from surfaces within the 'U'-shaped tubular housing; and f. an end cap secured to each mounting plate for closing each end of the 'U'-shaped tubular housing;

g. means for securing each end cap to each of the mounting plates resiliently urging each end cap against the end of the housing, and for allowing each end cap to translate perpendicularly with respect to the longitudinal axis of the tubular housing.

5. The luminaire of claim 4 wherein each end cap includes at least one circumferential protrusion and wherein the end cap closing one end of the 'U'-shaped tubular housing is oriented with the circumferential protrusion blocking an end of the external longitudinal male dovetail shoulder on one side of the housing, and the end cap closing the remaining end of the housing is oriented with the circumferential protrusion blocking an end of the external longitudinal female dovetail channel on the opposite side of the housing.

6. The luminaire of claim 5 wherein the means for resiliently securing each end cap to each of the mounting plates urging each end cap against the end of the housing, and for allowing each end cap to translate perpendicularly with respect to the longitudinal axis of the tubular housing comprises, in combination:

(i) a pair of aligned longitudinal slots penetrating through the end cap oriented perpendicularly with regard to a longitudinal axis oriented parallel to the extruded 'U'-shaped housing, (ii) a pair of threaded holes drilled into each end plate located to register with the slots penetrating through the particular end cap closing that end of the tubular housing;

(iii) a screw having a head and a threaded shank, the shank extending through the each slot through the end cap screwing into the registering threaded hole cut into the end plate;

(iv) a helical compression spring disposed around the shank of each screw between the head and the end cap, whereby, each end cap is translatable perpendicularly with respect to the longitudinal axis of the tubular housing with the compression springs resiliently urging the end cap against the end of the housing.

7. The luminaire of claim 1 or 4 wherein the 'U'-shaped tubular housing further includes an external longitudinal, female dovetail channel on its bottom side.

* * * * *